US006931731B2

(12) United States Patent
Izumi et al.

(10) Patent No.: US 6,931,731 B2
(45) Date of Patent: Aug. 23, 2005

(54) ELECTRIC SHAVER

(75) Inventors: Yukio Izumi, Matsumoto (JP); Akira Hirabayashi, Matsumoto (JP); Seiji Iwashita, Matsumoto (JP); Hiroshi Kobayashi, Matsumoto (JP); Tetsuya Akabane, Matsumoto (JP); Hiromi Uchiyama, Matsumoto (JP)

(73) Assignee: Izumi Products Company, Nagano (JP)

( * ) Notice: Subject to any disclaimer, the term of this patent is extended or adjusted under 35 U.S.C. 154(b) by 27 days.

(21) Appl. No.: 10/444,240

(22) Filed: May 23, 2003

(65) Prior Publication Data

US 2003/0217468 A1 Nov. 27, 2003

(30) Foreign Application Priority Data

May 27, 2002 (JP) ..... 2002-152957

(51) Int. Cl.[7] ..... B26B 19/06
(52) U.S. Cl. ..... 30/43.1; 30/34.1; 30/43.92
(58) Field of Search ..... 30/43.1, 34.1, 30/43.92, 43.91

(56) References Cited

U.S. PATENT DOCUMENTS

| | | | | | |
|---|---|---|---|---|---|
| 3,339,276 | A | * | 9/1967 | Tolmie et al. | 30/34.1 |
| 4,866,843 | A | * | 9/1989 | Kumano | 30/34.1 |
| 5,189,792 | A | | 3/1993 | Otsuka et al. | |
| 5,265,336 | A | * | 11/1993 | Heintke | 30/34.1 |
| 5,611,145 | A | | 3/1997 | Wetzel et al. | |
| 5,943,777 | A | * | 8/1999 | Hosokawa et al. | 30/34.2 |
| 6,082,004 | A | | 7/2000 | Hotani | |
| 6,317,982 | B1 | * | 11/2001 | Andrew | 30/34.1 |

FOREIGN PATENT DOCUMENTS

| | | |
|---|---|---|
| JP | 2500199 | 10/1995 |
| JP | 8-318057 | 12/1996 |

* cited by examiner

*Primary Examiner*—Douglas D Watts
(74) *Attorney, Agent, or Firm*—Koda & Androlia

(57) ABSTRACT

An electric shaver with a cutter head that is equipped with a plurality of cutter units as movable units, and at least one cutter unit among these movable units being used after being fixed at a position where this cutter unit has been moved upward or downward from a standard position.

3 Claims, 11 Drawing Sheets

ELECTRIC SHAVER

BACKGROUND OF THE INVENTION

1. Field of the Invention

The present invention relates to an electric shaver and more particularly to an electric shaver in which a plurality of cutter units, each including an outer cutter and an inner cutter that reciprocates while making sliding contact with the outer cutter, are disposed side by side in the upper portion of the shaver main body.

2. Prior Art

In a typical reciprocating electric shaver, a cutter head is installed on the upper portion of a shaver main body that includes a driving source (motor), a driving mechanism, a power supply, an operating switch, etc. The cutter head is comprised of one or more main cutter units and an auxiliary cutter unit, which are installed side by side. Each of the main cutter units comprises a combination of a foil-form outer cutter and an inner cutter that makes a reciprocating motion while making sliding contact with the inside surface of the outer cutter. The auxiliary cutter unit comprises a combination of a slit-form outer cutter (e.g., an edge-trimming cutter or a rough shaving cutter) and an inner cutter that makes a reciprocating motion while making sliding contact with the inside surface of the outer cutter.

FIG. 14 shows one example of the cutter head of an electric shaver.

The cutter head 101 is detachably mounted on a shaver main body (not shown). The cutter head 101 is equipped with a plurality of cutter units 102 in which foil-form outer cutters and inner cutters that are driven in a reciprocating motion are combined. The cutter head 101 is further equipped with a rough shaving cutter 103, which is used for the rough shaving of unmanageable whiskers and long whiskers, etc., and an edge-trimming cutter 104, which is used to shave sideburns, which are installed adjacent to the cutter units 102. The edge-trimming cutter 104 is connected to the operating part of the shaver main body, so that it is used with its height position adjusted in three stages that include the areas indicated by broken lines.

In the electric shaver shown in FIG. 14, since the height positions of the cutter units are fixed, the area that contacts the skin in cases where, for example, whiskers under the nose or whiskers under the jaw are shaved is limited, so that unmanageable whiskers tend to shaved with an insufficient correction. Consequently, shaving stubble tends to be generated, and the finished shave tends to be insufficient. In cases where shaving stubble is generated, it may be necessary to redo the same shaved surface several times, dripping the shaving efficiency. Furthermore, in cases where the edge-trimming cutter is merely adjustable to an upper or lower position, there is no variation in the cutter surface that corresponds to the surface of the skin with various shaved surfaces such as the cheeks, area under the nose and area under the jaw, etc., so that a sufficient function cannot be manifested.

SUMMARY OF THE INVENTION

Therefore, it is an object of the present invention to solve the above-described problems encountered in the prior art.

It is another object of the present invention to provide an electric shaver that can provide optimal cutter surfaces that correspond to a shaving area and can form an optimal skin contact angle.

The above objects are accomplished by a unique structure for an electric shaver of the present invention that includes a cutter head which is installed on an upper portion of a shaver main body and a plurality of cutter units each having an outer cutter and an inner cutter that reciprocates while making sliding contact with an inside surface of the outer cutter; and in the present invention, the cutter head is equipped with a plurality of cutter units as movable units, and at least one of cutter unit of such plurality of movable units is movable to a predetermined position that is upward or downward from a standard or normal position and fixed in place to be used.

In this structure, the movable units include at least one movable cutter unit that has a foil-form outer cutter.

Also, the angle of inclination of the cutter head with respect to the shaver main body is varied when the movable cutter unit is moved to the predetermined position in the vertical direction from the standard or normal position.

In addition, a positional movement operation of the movable cutter unit and an inclination operation of the cutter head are performed in linkage with each other.

Furthermore, the cutter head is provided therein side by side with, in addition to the movable cutter unit which has a foil-form outer cutter, a movable cutter unit which has a foil-form outer cutter, a rough shaving cutter unit which has a slit-form outer cutter, a main cutter unit which has a foil-form outer cutter, and an edge-trimming cutter unit which has a slit-form outer cutter; and wherein the angle of inclination of the cutter head with respect to the shaver main body is varied when the movable cutter unit is moved to the predetermined position in the vertical direction from the standard or normal position.

DETAILED DESCRIPTION OF THE INVENTION

Preferred embodiments of the present invention will be described in detail below with reference to the accompanying drawings.

Figure 2A:
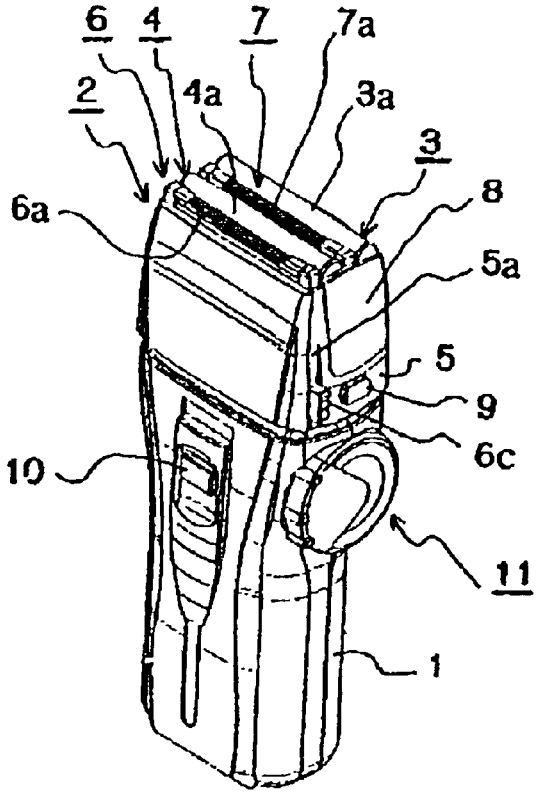
FIGS. 2(*a*) and 2(*b*) are external perspective views of the electric shaver according to the present invention.
Figure 2B:
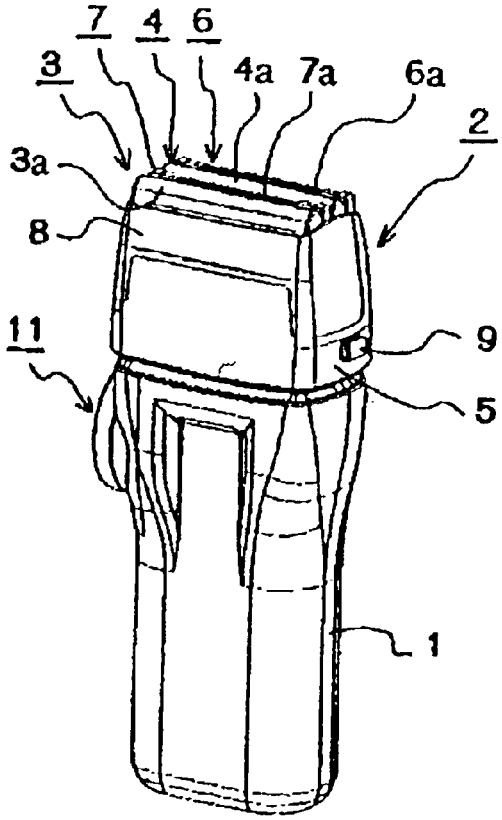

First, the schematic construction of the electric shaver will be described with reference to FIGS. 2(*a*) and 2(*b*) and FIG. 7. A cutter head 2 is installed on the upper portion of a shaver main body 1, and this shaver main body 1 is equipped with a driving source and driving mechanism. In the cutter head 2, a plurality of cutter units each comprising a combination of an outer cutter and an inner cutter that reciprocates while making sliding contact with the outer cutter are installed side by side. The cutter head 2 has a plurality of cutter units as movable units. In use of the shaver, at least one of the cutter units among these movable units is fixed in a position in which the cutter unit has been moved upward or downward from a standard position or a normal position.

In the shown embodiment, a movable cutter unit 3, which has foil-form outer cutters 3*a*, and an edge-trimming cutter unit 6, which has slit-form outer cutters 6*a*, are provided as movable units. As will be described later, in use, the movable cutter unit 3 or the edge-trimming cutter unit 6 is fixed at a position after the cutter unit is moved upward or downward. The other cutter units, i.e., the main cutter unit 4 which has foil-form outer cutters 4*a* and the rough shaving cutter unit 7 which has slit-form outer cutters 7*a* are used "as is" without being moved upward or downward.

The edge-trimming cutter unit 6 is mounted on the cutter head frame 5 so as to be adjacent to the main cutter unit 4. The edge-trimming cutter unit 6 includes a slit-form outer cutter 6*a* and an inner cutter 6*b* that makes a reciprocating motion while making sliding contact with the inside surface of the outer cutter 6*a*. The edge-trimming cutter unit 6 is used mainly for shaving sideburns (see FIG. 7). The edge-trimming cutter unit 6 is connected to an operating lever 6*c*. The operating lever 6*c* passes through a guide hole 5*a* formed in the vertical direction in the cutter head frame 5 and protrudes to the outside of the frame. A roulette is formed in the outside surface of this operating lever 6*c*. The cutter surface of the edge-trimming cutter unit 6 is caused to protrude upward for use by catching the fingers on the roulette and sliding the operating lever 6*c* along the guide hole 5*a*.

The rough shaving cutter unit 7 is mounted on the cutter head frame 5 by being installed between the main cutter unit 4 and movable cutter unit 3. The rough shaving cutter unit 7 includes a slit-form outer cutter 7*a* and an inner cutter 7*b* that make a reciprocating motion while making sliding contact with the inside surface of the outer cutter 7*a*. The rough shaving cutter unit 7 is used mainly for shaving long whiskers or unmanageable whiskers (see FIG. 7).

After rough shaving has been performed with this rough shaving cutter unit 7, finishing shaving is performed by the movable cutter unit 3 or main cutter unit 4. The movable cutter unit 3 and main cutter unit 4 are respectively equipped with foil-form outer cutters 3*a* and 4*a* and inner cutters 3*b* and 4*b* that reciprocate while making sliding contact with the inside surfaces of the outer cutters 3*a* and 4*a* (see FIG. 7). The outer cutter 4*a* of the main cutter unit 4, the outer cutter 7*a* of the rough shaving cutter unit 7 and the outer cutters 3*a* of the movable cutter unit 3 are supported on an outer cutter frame 8 (see FIGS. 2(*a*) and 2(*b*)). The outer cutter frame 8 can be separated from the cutter head 2 by means of an outer cutter frame detachment key 9 installed on the cutter head 2 (see FIG. 3(*a*)).

Furthermore, a main switch 10 is disposed on the front face of the shaver main body 1. With the operation of the main switch 10, the inner cutters installed in the movable cutter unit 3 and in the main cutter unit 4 are driven to reciprocate. Moreover, a mode-switching dial 11, which is one example of a mode-switching section, is provided on one side face of the shaver main body 1. By way of rotating the mode-switching dial 11 in a specified direction, the movable cutter unit 3 is moved upward or downward from a standard position, and the angle of inclination of the cutter head 2 with respect to the shaver main body 1 is varied, as will be described later.

Next, the construction of the respective elements of the electric shaver will be described with reference to FIGS. 3(*a*) through 8.

Figures 3A, 3B:
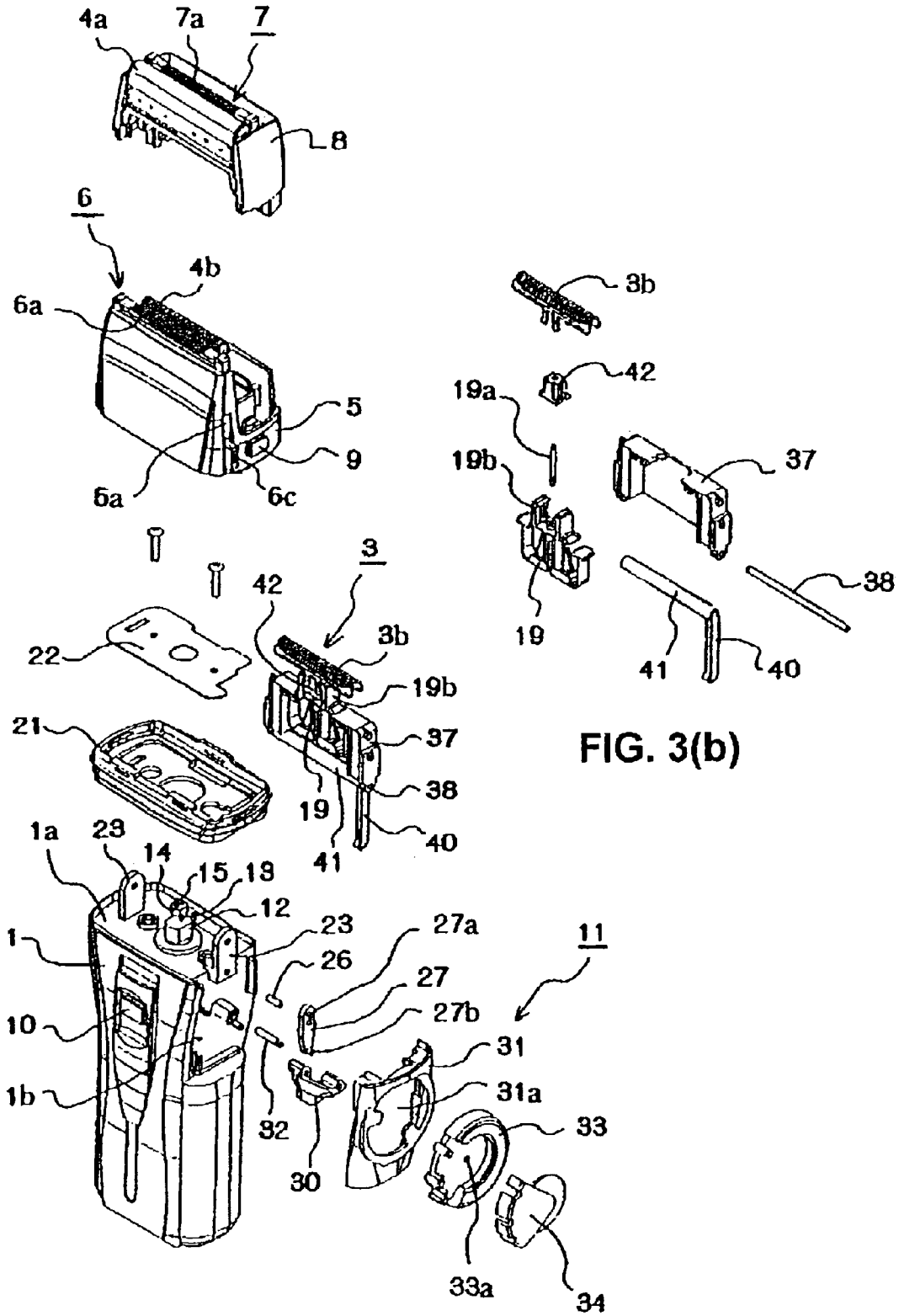
FIGS. 3(*a*) and 3(*b*) are exploded perspective views of the electric shaver and the movable cutter unit of the present invention.

In FIG. 3(*a*), a first motor joint portion 12, a first eccentric pin 13, a second motor joint portion 14 and a second eccentric pin 15 are installed on the upper surface of the shaver main body 1 so that these elements are connected in the axial direction. The second motor joint portion 14 is an eccentric joint portion that is connected via the first eccentric pin 13. The first and second eccentric pins 13 and 15 are installed upright at positions whose phases are substantially reversed above and below the second motor joint portion 14.

Figure 7:
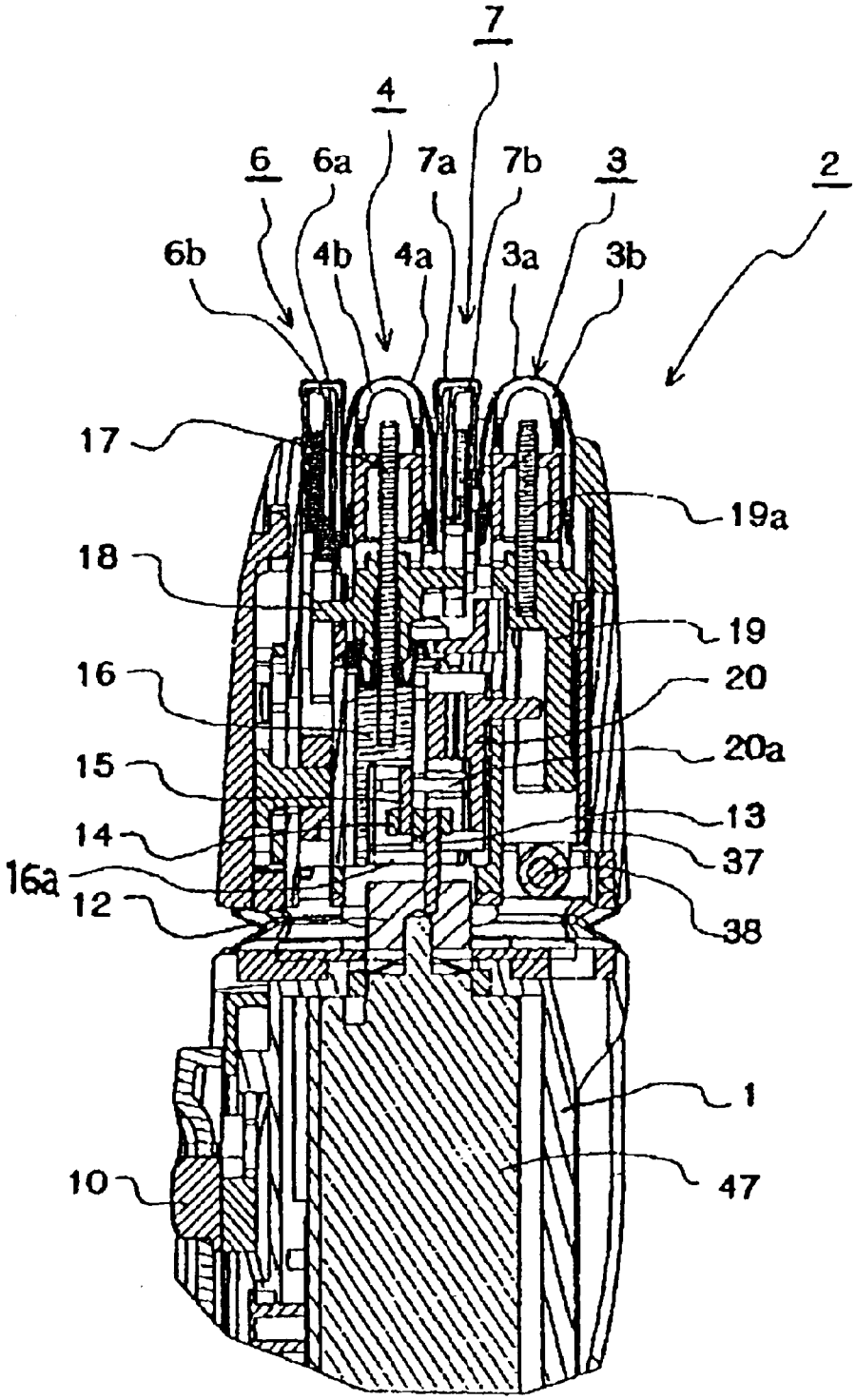
FIG. 7 is a sectional view taken along the line 7—7 in FIG. 5.

In FIG. 7, the inner cutter 4*b* of the main cutter unit 4 is connected to the oscillator shaft 17 of a first oscillator 16. The oscillator connecting portion 16*a* of the first oscillator 16 is groove-engaged with the first eccentric pin 13. A cutter connecting body 18 is engaged with the oscillator shaft 17. This cutter connecting body 18 is connected to the edge-trimming cutter unit 6 and rough shaving cutter unit 7. The inner cutter 3*b* of the movable cutter unit 3 is connected to the movable oscillator shaft 19*a* of a movable oscillator 19. Furthermore, the movable oscillator 19 is connected to a second oscillator 20 so that the movable oscillator 19 is movable upward and downward with respect to the second oscillator 20. The movable oscillator 19 is installed so that its movement in the vertical direction is free and only movement in the horizontal direction is restricted, thus preventing any interference with the second oscillator 20 even if the movable cutter unit 3 is moved upward and downward. The oscillator connecting portion 20*a* of the second oscillator 20 is groove-engaged with the second eccentric pin 15.

The first eccentric pin 13 and second eccentric pin 15 are installed upright at positions whose phases are substantially reversed above and below the second motor joint portion 14. The first oscillator 16 is connected to the first eccentric pin 13, and the second oscillator 20 is connected to the second eccentric pin 15. As a result, the rotational driving of the second motor joint portion 14 is converted into mutually opposite reciprocating motions by the first oscillator 16 and second oscillator 20 and is transmitted to the inner cutters of the respective cutter units.

When the driving motor 47 is started, driving is transmitted to the main cutter unit 4, edge-trimming cutter unit 6 and rough shaving cutter unit 7 via the first oscillator 16 and is transmitted in the opposite directions to the movable cutter unit 3 via the second oscillator 20 and movable oscillator 19. In this case, the respective inner cutters 4*b*, 6*b* and 7*b* of the main cutter unit 4, edge-trimming cutter unit 6 and rough shaving cutter unit 7 and the inner cutters 3*b* of the movable cutter unit 3 are driven in a reciprocating motion in mutually opposite directions.

Figure 5:
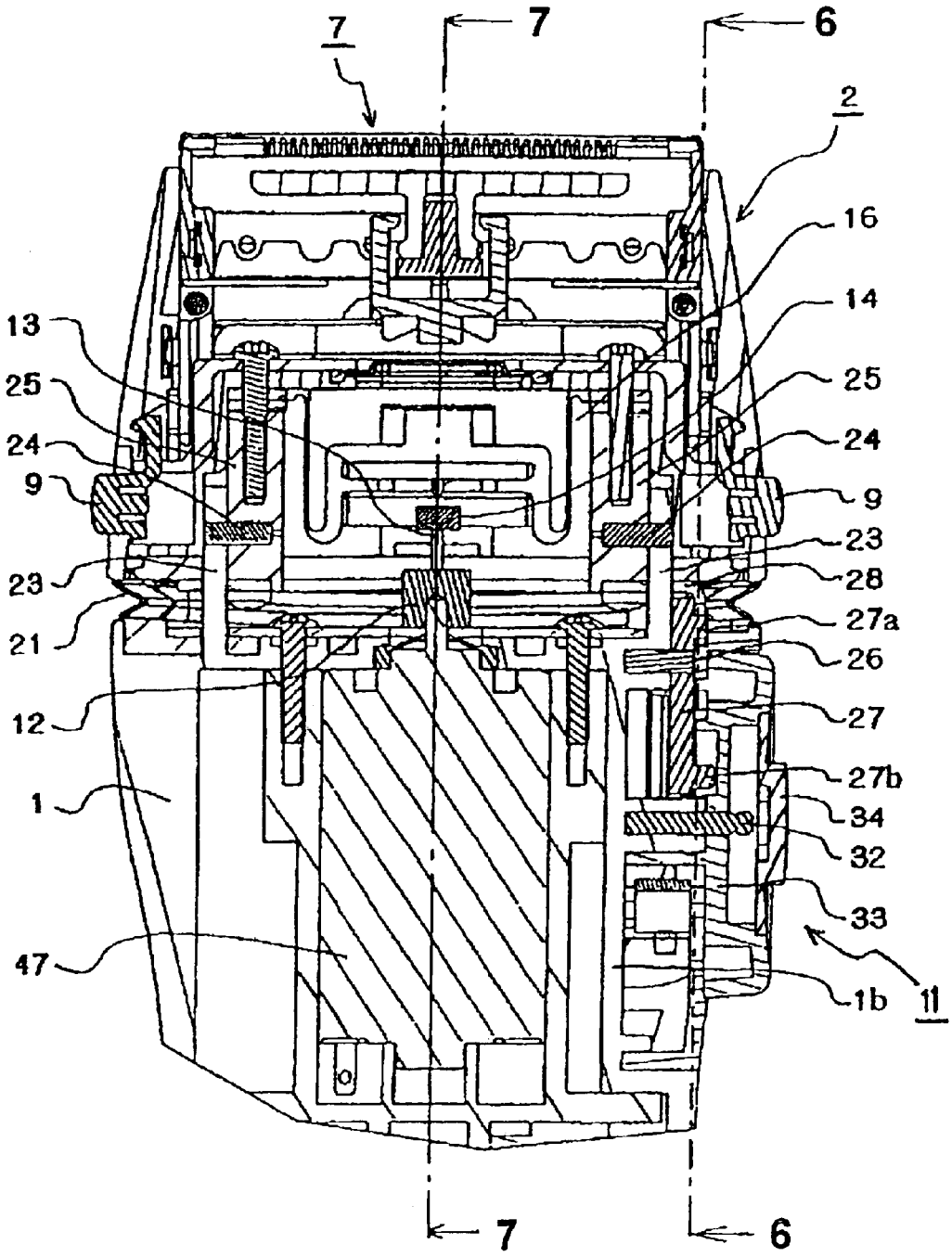
FIG. 5 is an enlarged sectional view of a part of the central portion of the electric shaver according to the present invention the electric shaver

Furthermore, in FIG. 3(*a*), projected supporting elements 23 project on the left and right sides from the upper surface 1*a* of the shaver main body 1. A neck cover 21 is screw-fastened to the upper surface 1*a* by a fastening fitting 22. In FIG. 5, the projected supporting elements 23 are provided so as to protrude above the neck cover 21, and head supporting shafts 24 are inserted into engaging holes formed in the upper ends of the projected supporting elements 23. A head base 25 is fitted over these head supporting shafts 24, thus supporting the cutter head 2 so that the cutter head 2 can pivot.

Figure 6:
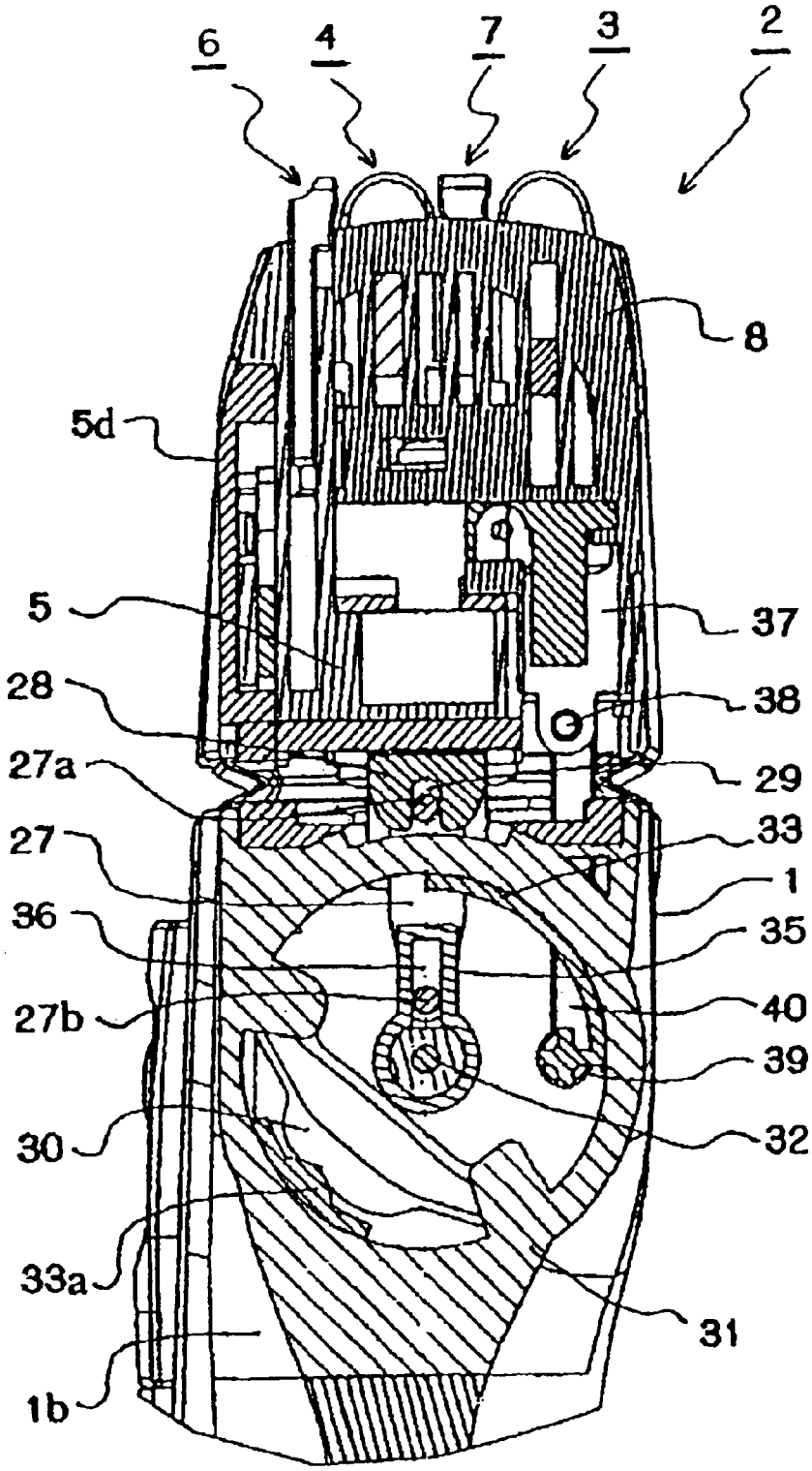
FIG. 6 is a sectional view taken along the line 6—6 in FIG. 5.

Furthermore, as seen from FIG. 5, a connecting body supporting shaft 26 is inserted into the side face portion 1*b* of the shaver main body 1. An arm-form head connecting body 27 is supported on this connecting body supporting shaft 26 so that the head connecting body 27 can pivot. Engaging pins 27*a* and 27*b* are respectively caused to protrude from both ends of the head connecting body 27. Furthermore, in the cutter head 2, a reinforcing plate 28 is disposed in the bottom portion of the head base 25. As shown in FIG. 6, a recessed groove 29 is formed in a depending part of the reinforcing plate 28 that is bent in the vertical direction. The engaging pin 27*a* on one end of the head connecting body 27 is inserted into the recessed groove 29 of the reinforcing plate 28.

Furthermore, a mode-switching dial 11 is built into the side face portion 1*b* of the shaver main body 1 so that the mode-switching dial 11 can be turned. The manner to mount the mode-switching dial 11 will be described below with reference to FIG. 3(*a*). A mode key clicking body 30 is connected to a side surface cover 31 and integrally attached to the side face portion 1*b*. The side surface cover 31 is fitted so as to cover the outside of the head connecting body 27. An engaging opening 31*a* is formed in this side surface cover 31. Furthermore, in the side face portion 1*b*, a dial shaft 32 is inserted into the central position of the engaging opening 31*a*. A mode key 33 and mode cover 34 are integrally engaged with this engaging opening 31*a*, and the mode key 33 is provided so as to be rotated about the dial shaft 32.

As shown in FIG. 6, a rib 35 is disposed around an engaging opening 33*a* whereby the mode key 33 is engaged with the dial shaft 32. An engaging groove 36 surrounded by this rib 35 is disposed in the direction of diameter. The engaging pin 27*b* on the other end of the head connecting body 27 is inserted into the engaging groove 36. Furthermore, one end of a link arm 40 is connected to the arm shaft 38 of an oscillator holder 37 which is disposed in the bottom portion of the movable cutter unit 3, and the other end of this link arm 40 is connected to a boss 39 disposed on the mode key 33.

The manner of mounting the movable cutter unit 3 will be described with reference to FIG. 3(*b*). The link arm 40 is formed in an L shape as an integral part of a holding shaft 41. This holding shaft 41 is built into the oscillator holder 37 in the horizontal direction, and an arm shaft 38 is inserted coaxially with the holding shaft 41, so that the link arm 40 is supported in a depending attitude. Furthermore, the movable oscillator 19 is integrally built into the oscillator holder 37. A movable oscillator shaft 19*a* is inserted into a connecting portion 19*b* that is disposed on the upper part of this movable oscillator 19. A movable inner cutter float element 42 is fitted over the movable oscillator shaft 19*a*, and the movable inner cutters 3*b* are held in this movable inner cutter float element 42.

Accordingly, the oscillator holder 37 can be pushed upward or pulled downward via the link arm 40 by turning the mode-switching dial 11, so that the movable cutter unit 3 can be moved upward or downward.

Furthermore, the position of the mode-switching dial 11 is arranged so that the shaver can be used with the dial position (position of the movable cutter unit 3) fixed by the engagement of the mode key clicking body 30 and the clicking portion 33*a* of the mode key 33. In the shown embodiment, as will be described later, the electric shaver is designed so that mode switching can be performed among three positions: a normal mode (for use on the cheeks), an under-the-nose mode (for use under the nose), and an under-the-jaw mode (for use under the jaw). As a result, as shown in the model diagram in FIG. 8, the movable cutter unit 3 can be respectively moved to a normal position, upper position or lower position and fixed in these positions.

Figure 4:
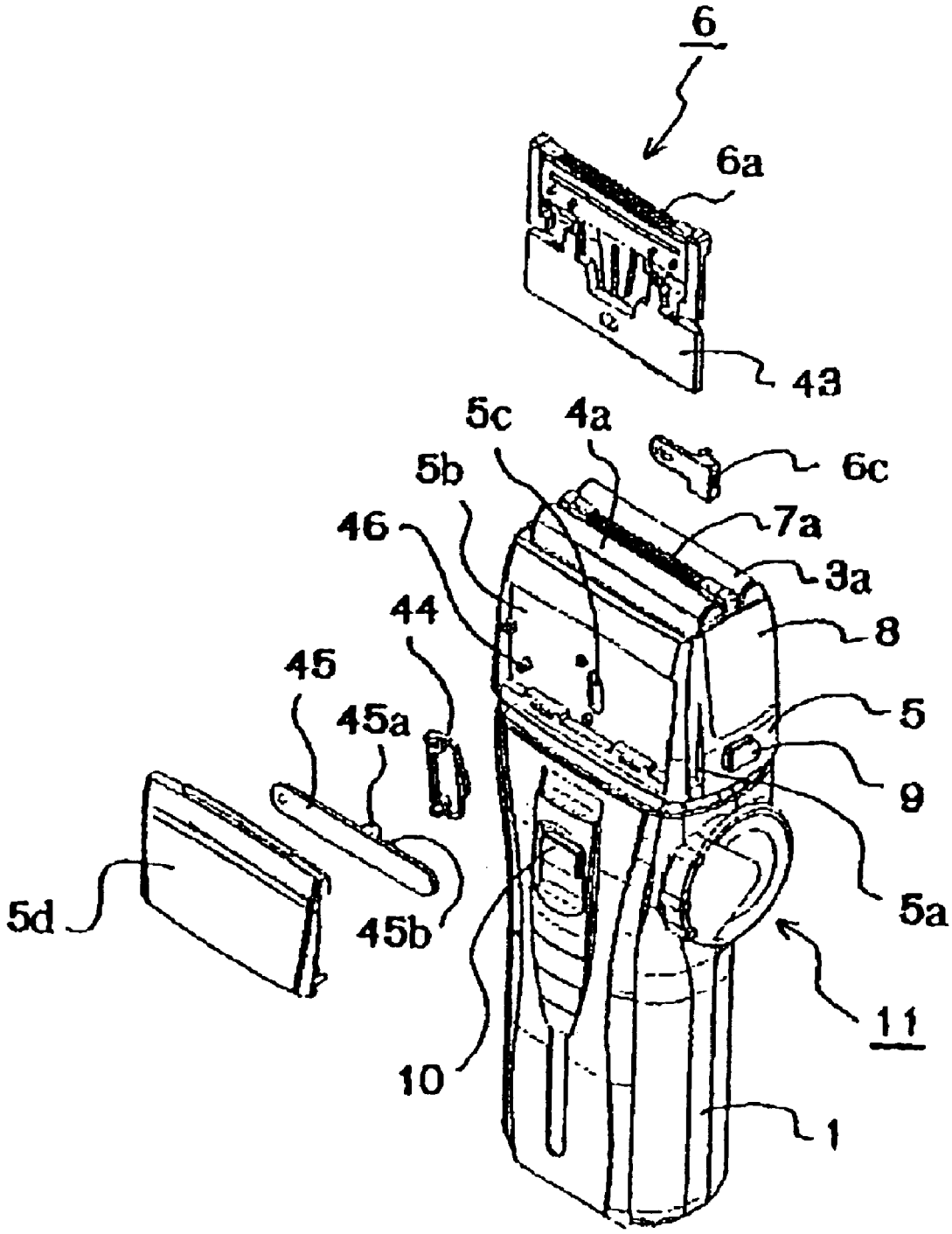
FIG. 4 is an exploded perspective view of the edge-trimming cutter of the electric shaver according to the present invention.

Next, the manner of mounting the edge-trimming cutter unit 6 will be described with reference to FIG. 4. The edge-trimming cutter unit 6 is used mainly in cases where sideburns are trimmed. The edge-trimming cutter unit 6 is integrally supported on an edge-trimming cutter base 43 and is built into an attachment section 5*b* on the front face of the cutter head frame 5. An edge trimming clicking body 44 is attached to this attachment section 5*b*,and edge-trimming cutter is mounted so that this unit can be pushed in from the outside by an edge-trimming lever 45 and head plate 5*d*.

Figure 8:
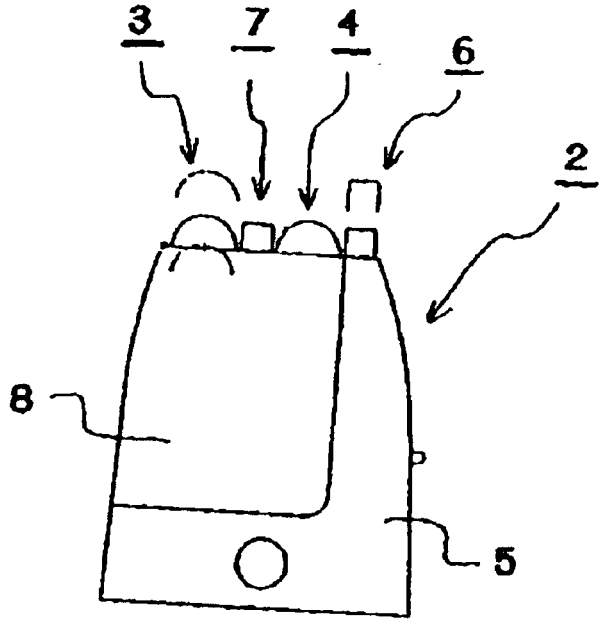
FIG. 8 is a model diagram of the cutter head of the electric shaver according to the present invention.

One end of the edge-trimming lever 45 is engaged with a lever shaft 46 installed in the attachment section 5*b*, while the other end is connected to the operating lever 6*c*. A boss 45*a* and a clicking portion 45*b* are formed on the edge-trimming lever 45. A circular-arc-form guide hole 5*c* into which the boss 45*a* is inserted is formed in the attachment section 5*b*. The boss 45*a* passes through the guide hole 5*c* and is connected to the edge-trimming cutter base 43. When the operating lever 6*c* is moved upward or downward along the guide hole 5*a*, the edge-trimming lever 45 pivots about the lever shaft 46, so that the boss 45*a* rotates along the guide hole 5*c*. In this case, the edge-trimming cutter base 43 is moved upward or downward; and at the same time, the edge-trimming cutter unit 6 is also moved. Then, when the clicking portion 45*b* enters into an engagement with the edge trimming clicking body 44, as shown in FIG. 8, the edge-trimming cutter unit 6 is fixed in the upper position or lower position.

Next, the mechanism that varies the angle of inclination of the cutter head 2 with respect to the shaver main body 1 when the movable cutter unit 3 is moved to a predetermined position in the vertical direction form the standard position will be described with reference to FIGS. 1(*a*) through 1(*c*). The angle of inclination of the cutter head 2 will be described with the vertical direction taken as an angle of zero degrees.

Figure 1C:
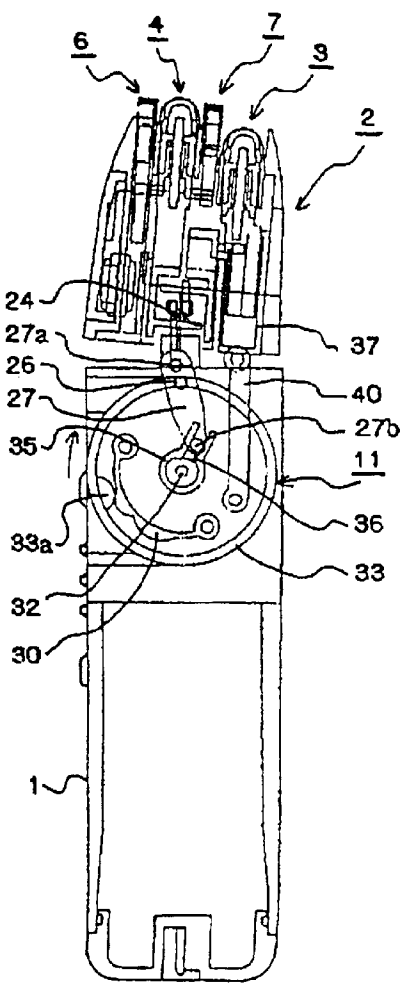
FIGS. 1(*a*) through 1(*c*) are explanatory diagrams showing the inside of the cutter head of the electric shaver according to the present invention in different operating modes.
Figure 1B:
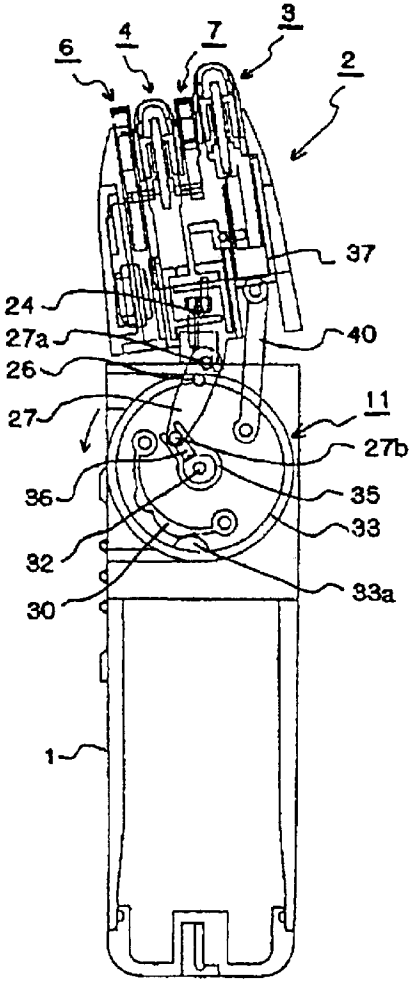
Figure 1A:
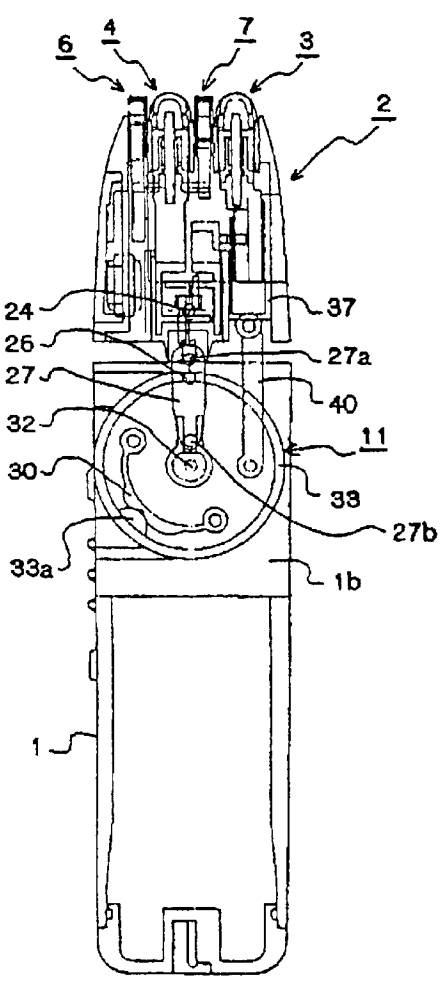

FIG. 1(*a*) shows a state in which the movable cutter unit 3 is in the standard position (normal mode). In this case, the link arm 40 connects the mode key 33 and oscillator holder 37 in an attitude that is parallel to the vertical direction. The angle of inclination of the cutter head 2 is maintained at zero degrees.

FIG. 1(*b*) shows a state in which the mode-switching dial 11 is rotated in the counterclockwise direction, so that the mode key 33 is rotated in the same direction, thus effecting positioning by engagement of the clicking portion 33*a* with the mode key clicking body 30 (under-the-nose mode). In this case, the movable cutter unit 3 is pushed upward by the link arm 40 and held in a height position where the movable cutter unit 3 protrudes further than the other cutter units of the cutter head 2. On the other hand, when the mode key 33 is rotated in the counterclockwise direction, the rib 35 also is rotated in the same direction, so that the engaging pin 27*b* of the head connecting body 27 that is connected to the engaging groove 36 is moved outward in the direction of diameter along the engaging groove 36. In this case, the head connecting body 27 is rotated slightly in the clockwise direction about the connecting body supporting shaft 26. As a result, the reinforcing plate 28 (see FIG. 6) to which the engaging pin 27*a* of the head connecting body 27 is connected is caused to swing in the counterclockwise direction, so that the shaver is used while held in a state in which the cutter head 2 has been rotated in the counterclockwise direction about the head supporting shafts 24. The angle of inclination of the cutter head 2 in this case is approximately 8.1 degrees, and the cutter head 2 is inclined slightly to the left with respect to the shaver main body 1.

FIG. 1(*c*) shows a state in which the mode-switching dial 11 is rotated in the clockwise direction, so that the mode key 33 is rotated in the same direction, thus effecting positioning by engagement of the clicking portion 33*a* with the mode key clicking body 30 (under-the-jaw mode). In this case, the movable cutter unit 3 is pulled downward by the link arm 40 and held in a height position where the movable cutter unit 3 is retracted further than the other cutter units of the cutter head 2. On the other hand, when the mode key 33 is rotated in the clockwise direction, the rib 35 is also rotated in the same direction, so that the engaging pin 27*b* of the head connecting body 27 connected to the engaging groove 36 is moved slightly outward in the direction of diameter along the engaging groove 36. In this case, the head connecting body 27 is rotated slightly in the counterclockwise direction about connecting body supporting shaft 26. As a result, the reinforcing plate 28 (see FIG. 6) to which the engaging pin 27*a* of the head connecting body 27 is connected is caused to swing in the clockwise direction, so that the shaver is used while held in a state in which the cutter head 2 has been rotated in the clockwise direction about the head supporting shafts 24. The angle of inclination of the cutter head 2 in this case is approximately 5 degrees, so that the cutter head 2 is inclined slightly to the right with respect to the shaver main body 1.

Next, the manner of uses of the electric shaver obtained by mode switching will be described below with reference to FIGS. 9 through 11.

Figure 9:
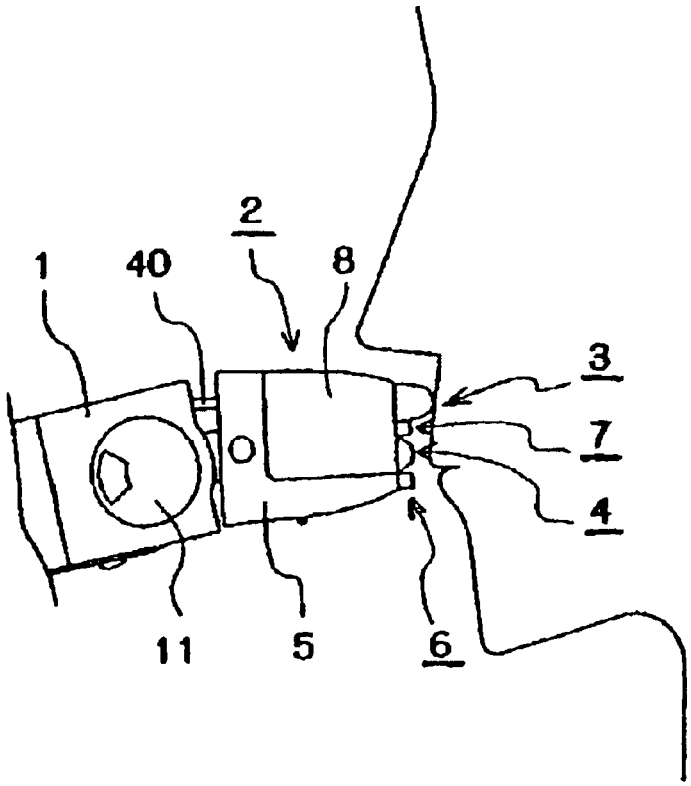
FIG. 9 is an explanatory diagram showing the manner of use in the under-the-nose mode of the electric shaver according to the present invention.

FIG. 9 shows a case in which the shaver is used in the under-the-nose mode. In this under-the-nose mode, the movable cutter unit 3 is raised and placed in a height position in which this movable cutter unit 3 protrudes beyond the other cutter units, and the cutter head 2 is inclined toward the side of the front face (toward the side of the main switch 10). With this set up, though the shaving area in the area under the nose is limited, and the shaving surface is curved, a sufficient contact area with the outer cutters 3*a* of the movable cutter unit 3 is secured; and since the cutter head 2 is inclined toward the front, an attitude that allows easy holding and easy operation by the user can be maintained.

Figure 10:
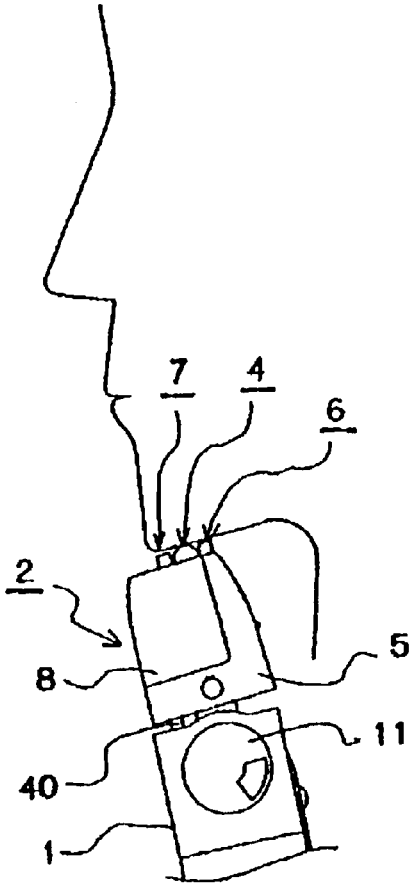
FIG. 10 is an explanatory diagram showing the manner of use in the under-the-jaw mode of the electric shaver according to the present invention.

FIG. 10 illustrates a case in which the shaver is used in the under-the-jaw mode. In this case, the movable cutter unit 3 is lowered in a height position in which the movable cutter unit 3 is retracted deeper than the other cutter units. The edge-trimming cutter unit 6 or rough shaving cutter unit 7 installed on either side of the main cutter unit 4 is moved back and forth under the jaw where unmanageable whiskers are common. Thus, ordinary whiskers are shaved by the main cutter unit 4 while unmanageable whiskers are shaved by the edge-trimming cutter unit 6 or rough shaving cutter unit 7. Thus, a shaving operation with good finishing shaving suited to the nature of the whiskers can be performed. Furthermore, by way of inclining the cutter head 2 slightly toward the opposite side from the front face side (the side with the main switch 10), the respective outer cutters can conform to the inclination of the area under the jaw. Thus, a sufficient contact area between the whiskers and the cutter surfaces is secured, and the convenience of use can be improved.

Figure 11:
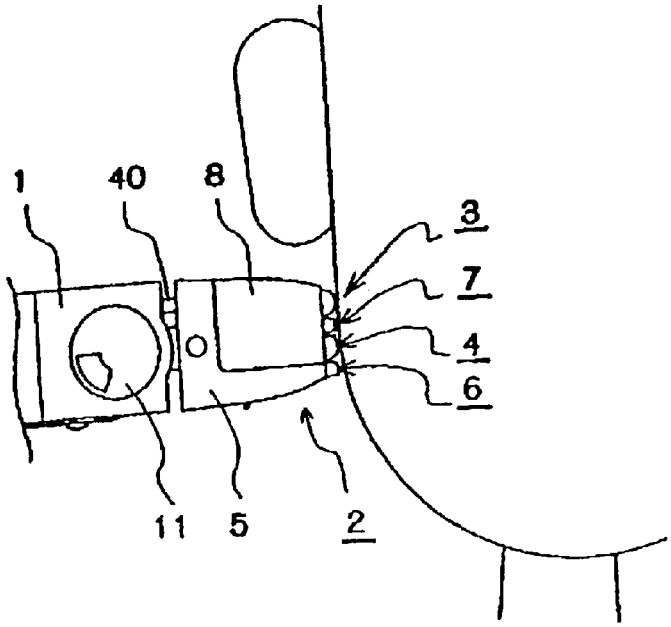
FIG. 11 is an explanatory diagram showing the manner of use in the normal mode of the electric shaver according to the present invention.

FIG. 11 shows a case in which the shaver is used in the normal mode. In this case, the cutter head 2 is not inclined with respect to the shaver main body 1, and the movable cutter unit 3 is kept in the standard position. In this normal mode, the cheeks, which have a relatively broad shaving area, is efficiently shaven by the cutter surfaces of all of the cutter units, i.e., the movable cutter unit 3, main cutter unit 4, edge-trimming cutter unit 6 and rough shaving cutter unit 7. Furthermore, with back and forth movements of the shaver body, finishing shaving can be performed by means of the main cutter unit 4 and movable cutter unit 3 while shaving unmanageable whiskers, a shaving operation with good shaving efficiency and finishing can be performed.

Figure 12:
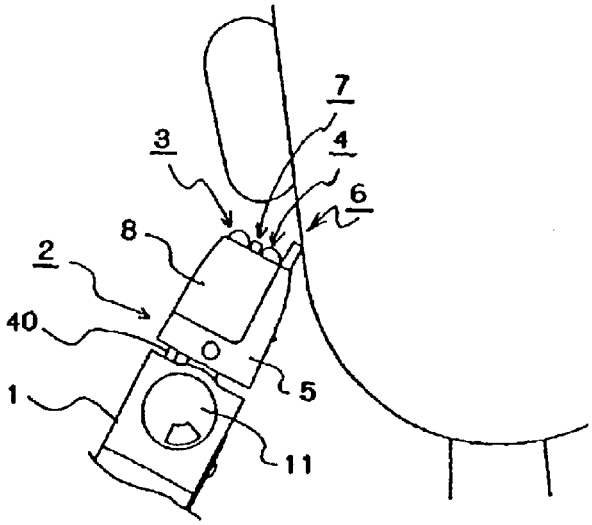
FIG. 12 is an explanatory diagram showing the manner of use in the edge-trimming mode of the electric shaver according to the present invention.

FIG. 12 shows a case in which the shaver is in the edge-trimming mode. The mode-switching dial 11 is in the normal position, and only the edge-trimming cutter unit 6 is raised and fixed in the upper position by the operating lever 6*c*. As a result, in cases where mainly sideburns are trimmed, the skin contact angle can be arbitrarily adjusted, and a shaving operation with good finishing is performed.

Figure 13A:
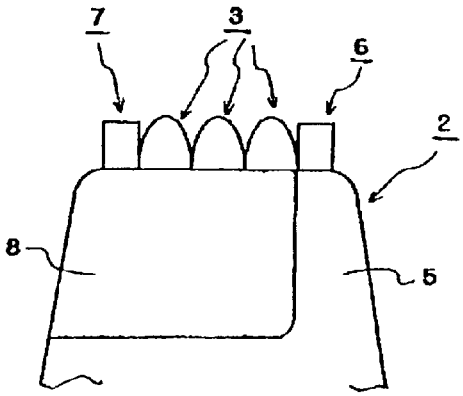
FIGS. 13(*a*) and 13(*b*) are explanatory diagrams showing the mode switching operation of the cutter head of the electric shaver of another embodiment of the present invention.
Figure 13B:
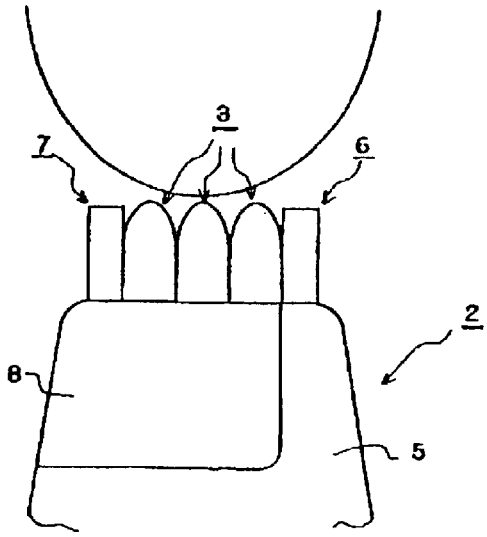
Figure 14:
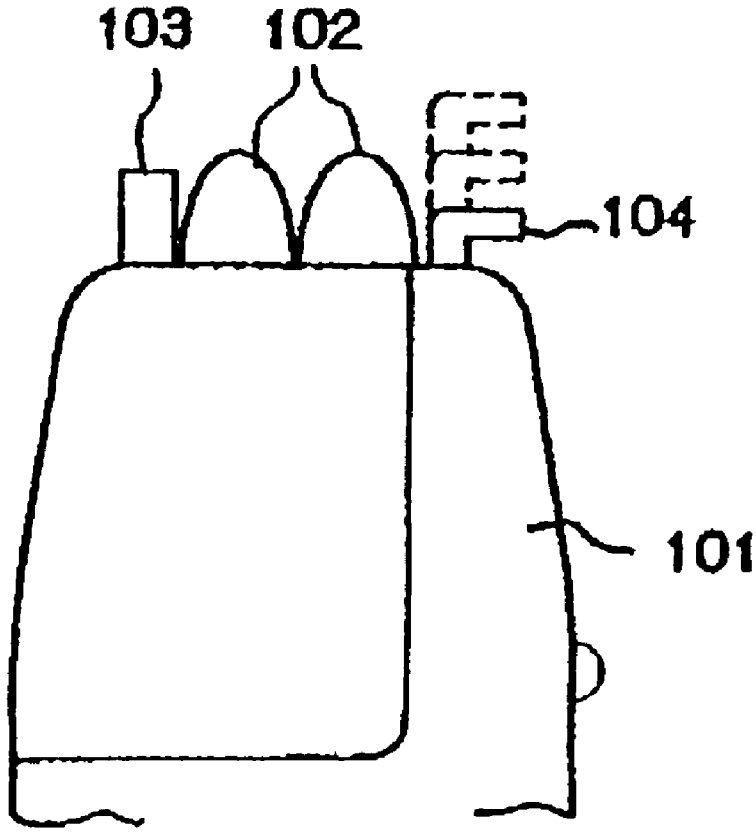
FIG. 14 PRIOR ART
FIG. 14 is an explanatory diagram of the cutter head of a conventional electric shaver.

Preferred embodiments of the present invention are described above. However, the present invention is not limited to the above-described electric shaver; and it is also possible to install a plurality of movable cutter units 3 instead of a single movable cutter unit 3. For example, as seen from FIGS. 13(*a*) and 13(*b*), the shaver can be structured so that movable cutter units 3 are installed in three locations in the cutter head 2, and an edge-trimming cutter unit 6 and a rough shaving cutter unit 7 are installed on both sides of the movable cutter units 3, so that the high positions of the cutter surfaces can be switched in the vertical direction by the mode-switching section. Furthermore, it is further possible to use the shaver while achieving variations in the heights of the cutter surfaces by increasing the combinations of one or more movable cutter units 3 with the main cutter unit 4.

In addition, the present invention is not limited to cases in which the movable cutter unit 3 is fixed in one of three positions, i.e., the standard position, upper position or lower position; and the shaver can be designed so that the movement positions of the cutter units can be switched in the vertical direction to an even larger number of positions. Moreover, the inner cutters of the cutter units that have foil-form outer cutters can be supported in a floating manner by bearings on which springs, etc. are spring-mounted, so that the inner cutters are caused to contact the inside faces of the outer cutters.

Furthermore, the arrangement of the movable cutter unit 3 and main cutter unit 4 that have foil-form outer cutters, and the edge-trimming cutter unit 6 and rough shaving cutter unit 7 that have slit-form outer cutters, is arbitrary; and these cutter units can be alternately installed, or the edge-trimming cutter unit 6 and rough shaving cutter unit 7 can be installed on both sides of the movable cutter unit 3 and main cutter unit 4.

Furthermore, the mode-switching section is not limited to a dial system; and the height positions of the cutter surfaces can be switched using some other type of system such as a lever system, etc. Thus, many modifications can be made within limits that involve no departure from the spirit of the invention.

In the electric shaver of the present invention, the cutter head is equipped with a plurality of cutter units as movable units; and in use of the shaver, at least one of these movable units is fixed at position after being moved upward or downward from a standard position. Accordingly, the shaver has increased variations in the cutter surfaces that contact the skin surface so that optimal cutter surfaces can be formed for shaving areas such as the area under the nose, the area under the jaw, and the cheeks, etc. Consequently, mode switching that varies the heights of the cutter surfaces of the movable units in accordance with the shaving area is accomplished, and efficient shaving with good finishing is possible.

Furthermore, the angle of inclination of the cutter head with respect to the shaver main body is varied when the movable cutter unit is moved upward or downward from the standard position. Thus, the shaver can easily be held by the user, and the optimal skin contact angle can be formed in accordance with the shaving area, thus providing convenience of use of an electric shaver.

What is claimed is:

1. An electric shaver comprising a cutter head which is installed on an upper portion of a shaver main body and a plurality of cutter units each having an outer cutter and an inner cutter that reciprocates while making sliding contact with an inside surface of said outer cutter, wherein said cutter head is equipped with a plurality of said cutter units as movable units, at least one of cutter unit of said plurality of movable units is moved to a predetermined position that is upward or downward from a standard position and fixed in place to be used wherein said movable units include at least one movable cutter unit that has a foil-form outer cutter, and an angle of inclination of said cutter head with respect to said shaver main body is varied when said movable cutter unit is moved to said predetermined position in a vertical direction from said standard position.

2. The electric shaver according to claim 1, wherein a positional movement operation of said movable cutter unit and an inclination operation of said cutter head linked together with each other.

3. An electric shaver comprising a cutter head which is installed on an upper portion of a shaver main body and a plurality of cutter units each having an outer cutter and an inner cutter that reciprocates while making sliding contact with an inside surface of said outer cutter, wherein said plurality of said cutter units are independently movable units, and said inner cutter of each of said plurality of cutter units is supported in a floating manner, at least one cutter unit of said plurality of cutter units is movable to a predetermined position that is upward or downward from a standard position and fixed in place to be used, and said plurality of cutter units are provided in said cutter head side by side and wherein said plurality of cutter units comprise:

a movable cutter unit which has a foil-form outer cutter, a rough shaving cutter unit which has a slit-form outer cutter, a main cutter unit which has a foil-form outer cutter, and an edge-trimming cutter unit which has a slit-form outer cutter, as well as said movable cutter unit which has a foil-form outer cutter, and wherein an angle of inclination of said cutter head with respect to said shaver main body is varied when said movable cutter unit is moved to said predetermined position in a vertical direction from said standard position.

* * * * *